United States Patent [19]

Keunen et al.

[11] Patent Number: 4,824,429

[45] Date of Patent: Apr. 25, 1989

[54] CENTRIFUGE FOR SEPARATING LIQUIDS

[75] Inventors: Martinus H. Keunen, Delden; Pieter J. A. de Bakker, Almelo, both of Netherlands

[73] Assignee: Ultra-Centrifuge Nederland N.V., Almelo, Netherlands

[21] Appl. No.: 168,275

[22] Filed: Mar. 15, 1988

[30] Foreign Application Priority Data

Mar. 18, 1987 [NL] Netherlands ..... 8700642

[51] Int. Cl.[4] ..... B04B 5/02; B04B 7/08

[52] U.S. Cl. ..... 494/16; 494/81

[58] Field of Search ..... 494/16, 81, 19; 210/781, 782

[56] References Cited

U.S. PATENT DOCUMENTS

| | | | |
|---|---|---|---|
| 1,730,776 | 10/1929 | Lundgren | 494/16 |
| 3,434,657 | 3/1969 | Luckham | 494/16 |
| 3,797,737 | 3/1974 | Kadotani | 494/13 |
| 3,913,828 | 10/1975 | Roy | 494/81 |
| 3,993,243 | 11/1976 | Dietzel | 494/81 |
| 3,997,106 | 12/1976 | Baram | 494/81 |
| 3,998,383 | 12/1976 | Romanauskas | 494/16 |
| 4,160,521 | 7/1979 | Lindgren | 494/81 |
| 4,449,965 | 5/1984 | Strain | 494/16 |
| 4,738,656 | 4/1988 | Piramoon | 494/81 |

*Primary Examiner*—Robert W. Jenkins

*Attorney, Agent, or Firm*—Cushman, Darby & Cushman

[57] ABSTRACT

A biomedical centrifuge having a rotor in the form of a body having rotational symmetry wherein, from a surface area thereof, cavities are provided which accommodate substantially cylindrical vessels. The cavities—as viewed in a plane normal to the axis of rotation of the rotor—are located at the angular points of a regular polygon. There is also provided a motor for rotating the rotor at a speed of many tens of thousands r.p.m. The rotor body is made of a cap-shaped frame of synthetic plastics material and the cavities are provided in the plastics material. The remainder of the frame is substantially hollow. On its radially outer the periphery, the frame is surrounded by reinforcing rings or a reinforcing envelope made of substantially tangentially oriented long fibres of suitable material.

11 Claims, 2 Drawing Sheets

CENTRIFUGE FOR SEPARATING LIQUIDS

BACKGROUND OF THE INVENTION

This invention relates to a centrifuge for separating liquids, comprising a rotor in the form of a body having rotational symmetry and having a surface through which a plurality of socket-type holes open, for accommodating respective substantially cylindrical vessels. The holes each lie in respective plans normal to the axis of rotation of the rotor at the angular points of a regular polygon. The rotor is designed to be mounted to a motor for rotating the rotor at a speed of many tens of thousands of revolutions per minute.

A centrifuge of this kind, also called a biomedical centrifuge, is known, e.g. from U.S. Pat. No. 3,248,046. The rotor of the known biomedical centrifuge is a substantially solid body. When the holes in the rotor are at a fixed angle to the axis of rotation, the rotor is called a "fixed-angle rotor". When the central axes of the holes are parallel to the axis of rotation, the rotor is called a "vertical rotor". In operation, cylindrical vessels, filled with liquid to be treated, are placed in the holes of the rotor. Upon rotation of the rotor, liquid particles of a larger specific mass will move relatively to liquid particles of smaller specific mass in the direction of the centrifugal accelaration, thereby effecting the desired separation.

Knwon centrifuges rotate at speeds of some tens of thousands of revolutions per minute, up to as much as about 70,000 r.p.m. and a centrifugal acceleration, in m/sec$^2$, of up to 500,000 g. The rotor should then be able to resist the centrifugal force exerted on the rotor by each vessel with liquid to be separated, as well as the liquid pressure produced in a vessel. To that end, the rotor consists mostly of an alloy of aluminum or of titanium, or as proposed in the above identified U.S. patent, of a mass of layers of glass fibre impregnated with a resinous binder. Such materials have a low density, which is important for proper handling and high strength, which together with low density, is important for a high centrifugal acceleration.

A drawback of the known centrifuges is that the choice of the design limits the maximum number of revolutions per minute. In spite of the fact that the above-identified U.S. patent suggests that the rotor proposed therein permits one to attain speeds of up to 100,000 r.p.m., this appears not to have been realized in actual practice. Besides, the rotor in the known centrifuges is heavy, so that its handling is adversely affected, as well as the so-called run-up and run-down times.

SUMMARY OF THE INVENTION

It is an object of the present invention to provide a centrifuge rotor wherein the above identified drawbacks occur to a much lesser extent. This object is realized according to the present invention with a centrifuge rotor wherein the body of the rotor is constituted by a cap-shaped frame of synthetic plastics material. Socket-like holes are provided in the plastics material and the remainder of the frame is substantially hollow. The frame is surrounded on its radially outer periphery by reinforcing rings or a reinforcing envelope, constituted by substantially tangentially-oriented long fibres of suitable material.

Because in the centrifuge rotor according to the present invention, the frame is substantially hollow, local high stresses in the material are prevented. Besides, as a result, the rotor can be kept light in weight, which promotes its wieldability. Because the frame is made of synthetic plastics material, which has a lower density than the metal of the known rotors, the weight is reduced still further.

It is observed that a biomedical centrifuge having a rotor comprising a cap-shaped frame of synthetic plastics material is already known per se from British Pat. No. 1,162,301. However, the centrifuge disclosed in that publication is a simple type of centrifuge designed for low speeds of maximally about 7,000 r.p.m. After this publication from 1969, the art has invariably proposed solid rotors, as may appear from the French patent application published under No. 2,317,966.

It is further acknowledged that it had been proposed earlier, for centrifuges of a different type, to provide the rotor, for the purpose of reinforcement, with enveloping layers made of one or more fibres. Such a proposal is laid down e.g., in the French application published under No. 2,151,074. Such proposals, although, as already mentoned, dating back to the early seventies, however, have not so far incited those skilled in the art of biomedical centrifuges to abandon the solid rotor.

The synthetic plastics material of the frame of the rotor of the centrifuge according to the present invention is e.g. a thermoplastic or thermosetting material. Preferably, this plastics material of the frame reinforced with randomly distributed short fibres. When such short fibres, having a length of mostly not more than 1 mm, are oriented randomly, the thus fibre-reinforced synthetic plastics material has isotropic properties. Such fibre-reinforced synthetic plastics material is injection-mouldable. By reason of its isotropic properties this plastics material can handle stresses occurring in any direction. Among the suitable synthetic plastics materials are polycarbonate, polyamide and acetal.

In order that the rotor according to the present invention should be capable of attaining high centrifugal accelerations, the frame is provided on its radially outer periphery with reinforcing rings or a reinforcing envelope made of substantially tangentially-oriented long synthetic plastics fibres. Preferably, the envelope or each ring is constituted one fibre or only a few fibres wound substantially tangentially or at a small angle and embedded in matrix material, so that up to 70–80% of the ring or envelope consists of fibre material. Suitable fibres are fibres of carbon, glass, aramide and the like.

When long fibres are oriented in a given direction, fibre-reinforced synthetic plastics material partly composed thereof has aniostropic properties.

In the centrifuge rotor according to the present invention, the low modulus of elasticity of the frame relative to the high modulus of elasticity of the reinforcing rings or envelope ensures a low stress in the frame and a high stress in said rings or envelope, so that the construction, as regards stress, is loaded uniformly. The high modulus of elasticity of rings or envelope limits so to say the elongation of the less strong parts of the frame.

Suitably, the reinforcing rings or envelope can be constructed in such a manner that they exhibit a stepped configuration on the radially outer surface of the sidewall of the frame. In such a stepped configuration, with contact surfaces normal to the axis of rotation, the ring or envelope not subject to forces directed away from the frame and rings or envelope are held firmly secured to the frame during rotation of the rotor. The rings or envelope are/is preferably secured to the frame by means of gluing or shrinking, thereby further increasing the solidity of the construction. This applies both to a frame with a stepped outer wall and to a skeleton with a smooth outer wall.

As a result of the suitable construction of the rotor of the centrifuge according to the present invention, in conjunction with the suitable choice of the material to be employed therein, the weight of the rotor relative to the known solid metal rotors is reduced by approximately a factor 3, so that the handling is considerably better. As, moreover, the polar mass moment of inertia will likewise be approximately a factor 3 smaller than of the known rotor, the run-up and run-down times can be substantially shortened. The maximally attainable centrifugal acceleration in the apparatus according to the present invention is appreciably higher than in the known apparatus. Rotation speeds about 10% higher than in the known apparatuses can be reached.

In the centrifuge according to the present invention, the socket-like holes in the rotor body may each be surrounded by an envelope essentially consisting of a tube with a closed bottom. Such a tube may consist of metal, of fibre-reinforced synthetic plastics material or of metal coated with fibre-reinforced synthetic plastics material. Such a tube has the object to resist the hydrostatic pressure in the liquid in the vessels to be placed in the holes, so that the frame is not overloaded. Another object may be to protect the frame against chemical attack.

BRIEF DESCRIPTION OF THE DRAWINGS

Some embodiments of the present invention will now be described, by way of example, with reference to the accompanying drawings, in which.

DETAILED DESCRIPTION

Figure 1:
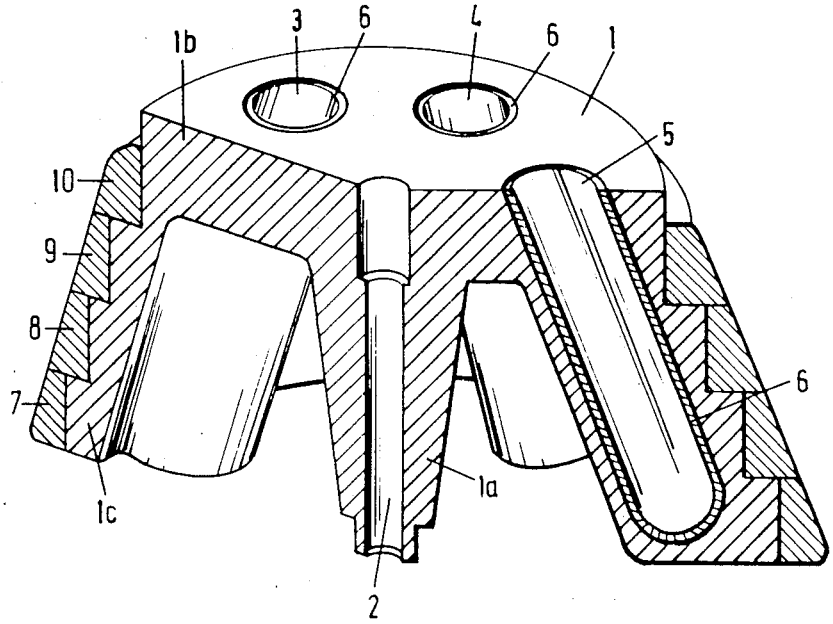
FIG. 1 is a part-sectional perspective view of an embodiment of the rotor of the centrifuge according to the present invention.

FIG. 1 is a cross-sectional and perspective view of a part of the rotor of an embodiment of the centrifuge according to the present invention. The rotor comprises a cap-shaped frame 1 of a suitable synthetic plastics material, e.g. polycarbonate, polyamide or acetal or another suitable thermoplastic or thermosetting material, preferably reinforced by incorporation therein of randomly distributed and randomly oriented short fibres. By "cap-shaped", it is meant that the rotor has a generally disk-shaped top or end wall from the radially outer periphery of which a skirt or sidewall depends. In the illustrated embodiments, the skirt is of a downwardly-flaring tubular form. The frame 1 further comprises a central portion 1*a* extending substantially longitudinally from a base on the inner side of the disk-shaped end wall of the frame 1, and provided with a suitable longitudinal bore 2 directed and extending along the axis of the frame which, in operation, receives a drive shaft coupled to the motor of the centrifuge. The manner in which the rotor of the centrifuge according to the present invention is driven and is connected to the drive shaft corresponds with the drive of known rotors and is not further described herein.

The upper end wall 1*b* is shown being externally flat, and the sidewall 1*c* is shown flaring downwardly so that its free end is located radially outwardly beyond the radially outer periphery of the end wall 1*b*. The upper end wall 1*b* has socket-like face contains holes 3,4,5, which are provided as cavities opening through the top face 1*b* and extending within the side wall 1*c*. In operation, vessels or containers containing liquid to be examined can be arranged in these socket-like holes or cavities 3,4,5. The holes or cavities are uniformly distributed angularly of the frame 1, in its sidewall 1*c* in such a manner that, in any plane perpendicular to the axis of rotation of the rotor, the centers of the transverse cross sections of the holes in the plane are the form the apices of an imaginary regular polygon. Holes 3,4,5 are internally provided with a layer 6, forming, for each hole, a respective liner in the respective hole. Layer 6 in each hole may, for example, be a tube made of a suitable material, e.g. stainless steel or titanium in a thickness of 0.5 mm, which may or may not be surrounded by an additional reinforcing layer of synthetic plastics material, reinforced with fibres extending unidirectionally, e.g. tangentially around the tube. Each tube is provided with an open end and a closed end. The layer 6, if consisting only of e.g. stainless steel, serves mainly as a chemical barrier, so that the rotor is not attacked by liquids from the vessels to be placed in the holes. An additonal layer of synthetic plastics material reinforced with unidirectionally oriented fibres having a thickness of e.g. 2 mm, if used, imparts substantial strength to the wall of the holes 3,4,5, so that, in operation, collapse of the frame and tube material surrounding the holes due to the high speed rotation of the rotor is prevented.

Figure 2:
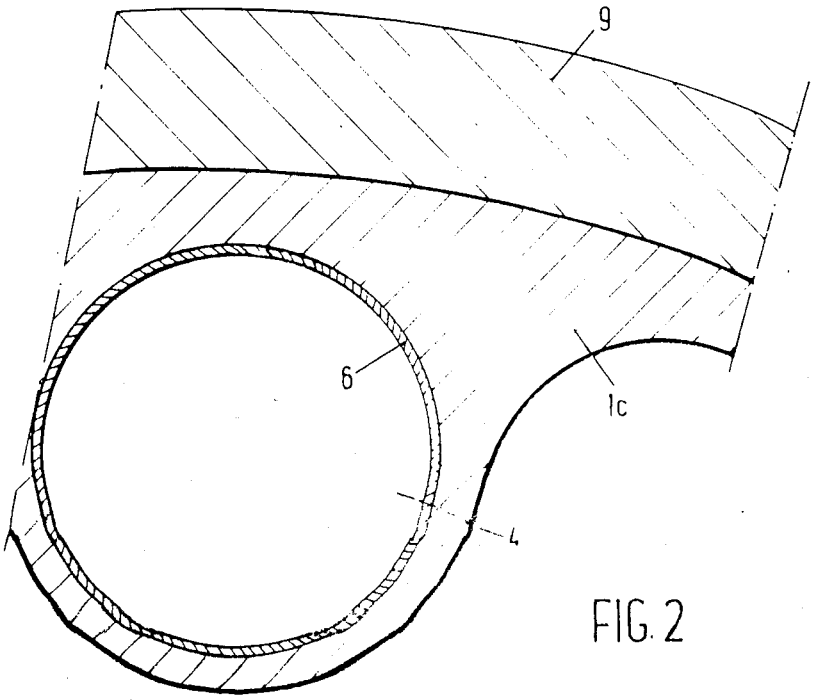
FIG. 2 is a fragmentary transverse cross-sectional view of a part of the apparatus shown in FIG. 1.

FIG. 1 and FIG. 2, show that the radially inner surface of the sidewall 1*c* of frame 1 has a wavy (i.e. an underlating) configuration in the circumferential direction, with the holes or cavities 3,4,5, together with the layers 6, always being fully surrounded by the material of wall 1*c* and the wall 1*c* extending axially beyond and thereby closing a respective inner end of each cavity 3, 4, 5.

On the exterior, the wall 1*c* is surrounded by a plurality of stepped reinforcing rings 7,8,9,10. Rings 7–10, secured by gluing or shrinking to the likewise stepped exterior of wall portion 1*c* of frame 1, each is made of substantially tangentially oriented long fibres of suitable material, e.g. carbon, glass, aramide or the like, embedded in a synthetic plastics matrix material. Preferably, each ring consists of one or only a few fibres which are wound substantially tangentially or at a small angle. As much as 80% of the thus-formed plastics material reinforced with unidirectionally-oriented fibres may consist of fibres.

Figure 3:
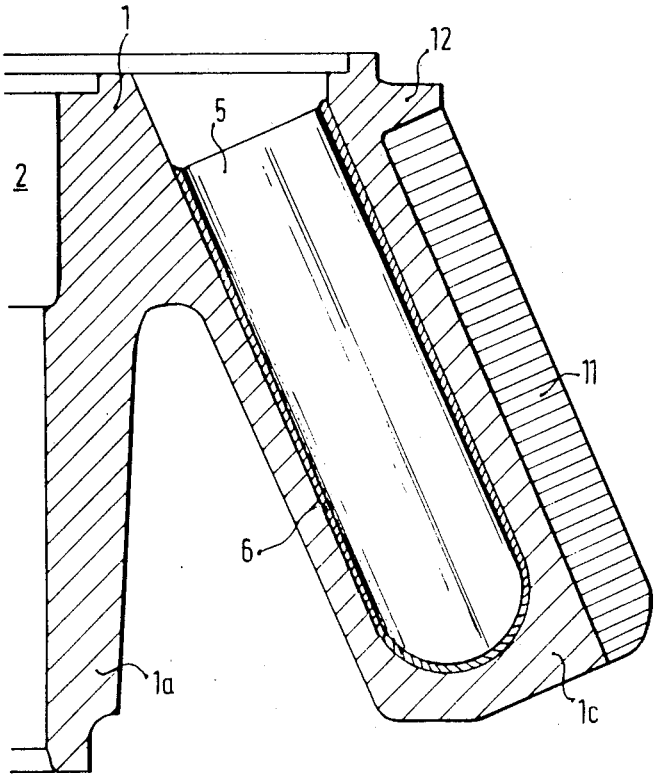
FIG. 3 is a fragmentary longitudinal cross-sectional view of another embodiment of the rotor of the centrifuge according to the present invention.

FIG. 3 is a cross-sectional view of another embodiment of the rotor of the centrifuge according to the present invention. The embodiment shown is a fixed-angle rotor having a "smooth" outer surface. Identical parts are indicated by the same reference numerals in FIGS. 1–3. Thus the rotor shown in FIG. 3 comprises a frame 1 of fibre-reinforced synthetic plastics material having a central portion 1*a* and a wall portion 1*c*. Central portion 1*a* contains the throughbore 2 for a drive shaft (not shown).

Extending from its top, a plurality of holes is provided in the frame, which are uniformly distributed over the frame, each making the same fixed angle with the axis of the body of frame 1. The figure shows the hole 5, which is lined with a layer 6 of stainless steel about 0.5 mm thick.

The frame 1 has a smooth radially outer wall on the periphery, this outer wall being surrounded by the envelope 11, which is made of substantially tangentially oriented long fibres of a suitable material embedded in synthetic plastics material. The envelope 11 is secured to frame 1 by means of suitable jointing techniques e.g. gluing. As shown, envelope 11 has a conical surface form and envelope 11 rests with its upper edge against a flanged part 12 of the frame 1. The figure shows a straight, smooth envelope 11. It will be clear that other envelope forms are also conceivable. In a manufacturing method wherein the envelope is formed by direct winding around the frame, the envenlope may, for instance, have a different form and conform to the shape of the frame to a greater extent.

The rotor of the centrifuge according to the present invention can be constructed so as to have desired dimensions. A rotor suitable for eight vessels of 40 ml, and hence provided with eight holes or cavities, will e.g., have a largest diameter of about 22 cm. The holes or cavities then each have a diameter of about 2.5 cm. The reinforcing rings or envelope in such a rotor is suitably about 1 cm thick.

We claim:

1. A rotor for a centrifuge for separating liquids, comprising:

a rotationally substantially symmetrical body having a disk-shaped end wall having a center and a radially outer periphery, said end wall having an axially outer surface and an axially inner surface, an outer peripheral sidewall depending from said radially outer periphery of said end wall so as to radially surround said axially inner surface of said end wall, and a central boss having one end based on said end wall, said boss extending longitudinally from said axially inner surface of said end wall so as to be radially spacedly surrounded by said sidewall, said sidewall having a radially outer surface, a radially inner surface, and, located distally of said end wall, a free end;

means defining a plurality of equi-angularly spaced socket-like holes in said body, each such hole having a mouth opening through said axially outer surface of said end wall of said body and extending longitudinally internally into said sidewall while being spaced from both said radially outer and radially inner surfaces of said sidewall and terminating in a closed end located axially short of said end of said sidewall; said holes, as seen in transverse cross-section, having longitudinal axes forming apices of an imaginary regular polygon;

each said hole having an inner peripheral surface extending from said mouth to said closed end thereof;

means provided on said central boss for mounting said rotor to a motor shaft for providing motorized rotation to said rotor;

said body being made of plastics material and characterized by being substantially hollow radially between said central boss and said radially inner surface of said sidewall; and reinforcing ring means disposed externally on said radially outer surface of said sidewall and mounted to said body for rotation therewith, said reinforcing ring means comprising at least one tangentially-oriented long fibre of reinforcement material.

2. The rotor of claim 1, wherein:

said plastics material of said body further includes a reinforcing filling of randomly-distributed short fibres of reinforcement material.

3. The rotor of claim 1, wherein:

said reinforcement ring means further comprises a matrix material in which said at least one tangentially-oriented long fibre is embedded; said at least one tangentially-oriented long fibre constituting up to 80 percent of said reinforcement ring means; and said at least one tangentially-oriented long fibre being wound about said sidewall so as to have a small helical angle longitudinally of said rotor.

4. The rotor of claim 1, wherein:

said radially outer surface of said sidewall is stepped and said reinforcement ring means comprises a plurality of rings each disposed on a respective step of said stepped surface.

5. The rotor of claim 4, wherein:

said sidewall flares toward said free end.

6. The rotor of claim 5, wherein:

said radially inner surface of said sidewall is undular circumferentially thereof.

7. The rotor of claim 6, wherein:

each said hole is provided with a lining covering said inner peripheral surface thereof.

8. The rotor of claim 1, wherein:

each said hole is provided with a lining covering said inner peripheral surface thereof.

9. The rotor of claim 8, wherein:

each lining comprises a metal tube having an open end and a closed end.

10. The rotor of claim 9, wherein:

said lining further comprises a coating of fibre-reinforced synthetic plastics material provided on each said metal tube.

11. The rotor of claim 8, wherein:

each lining comprises a fibre-reinforced synthetic plastic tube having an open end and a closed end.

* * * * *